US011835306B2

(12) United States Patent
Zou

(10) Patent No.: US 11,835,306 B2
(45) Date of Patent: Dec. 5, 2023

(54) FINNED TUBE HEAT EXCHANGERS AND METHODS FOR MANUFACTURING SAME

(71) Applicant: Rheem Manufacturing Company, Atlanta, GA (US)

(72) Inventor: Yang Zou, Dallas, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 17/190,596

(22) Filed: Mar. 3, 2021

(65) Prior Publication Data

US 2022/0282936 A1 Sep. 8, 2022

(51) Int. Cl.
*F28F 1/28* (2006.01)

(52) U.S. Cl.
CPC ..... *F28F 1/28* (2013.01)

(58) Field of Classification Search
CPC ..... F28F 1/28; F28F 1/30; F28F 1/325
See application file for complete search history.

(56) References Cited

U.S. PATENT DOCUMENTS 1,960,955 A * 5/1934 Recker ..... F28F 1/30 138/144
3,443,634 A * 5/1969 Pasternak ..... F28D 1/0477 165/182
3,724,537 A * 4/1973 Johnson ..... F28F 1/32 264/516
4,434,844 A * 3/1984 Sakitani ..... F28F 1/325 165/133
5,582,246 A * 12/1996 Dinh ..... F28F 1/24 165/181
5,660,230 A * 8/1997 Obosu ..... F28F 1/325 165/182
6,266,882 B1 * 7/2001 Ali ..... F28F 1/24 29/890.03
7,152,667 B2 * 12/2006 Mochizuki ..... F28D 15/0275 165/104.34
11,054,186 B2 * 7/2021 Yoshimura ..... F28F 1/32
11,274,834 B2 * 3/2022 Lee ..... F24F 1/00
2004/0026073 A1 * 2/2004 Alex ..... F28F 3/02 165/182

(Continued)

FOREIGN PATENT DOCUMENTS

CN 103765148 A * 4/2014 ..... F28D 1/0477
CN 109813171 A * 5/2019
JP 3982768 B2 * 9/2007

*Primary Examiner* — Jon T. Schermerhorn, Jr.
(74) *Attorney, Agent, or Firm* — Eversheds Sutherland (US) LLP

(57) ABSTRACT

A heat exchanger fin is disclosed. The fin can include a fin portion and a collar portion defining a fin aperture that has a central axis passing therethrough. The collar portion can include a nesting end including a nesting portion and a receiving end that (i) is located apart from the nesting end in an axial direction and (ii) comprises one or more bends to form an overhang portion that defines a gap located radially inward of the overhang portion. The gap can be dimensioned to at least partially receive the nesting portion. The collar portion can also include a contact portion extending between the nesting end and the receiving end, and the contact portion can be configured to abut an outer surface of a tube when the tube is at least partially inserted into the fin aperture.

7 Claims, 12 Drawing Sheets

(56) References Cited

U.S. PATENT DOCUMENTS

| | | | | |
|---|---|---|---|---|
| 2011/0067849 | A1* | 3/2011 | Fujino | F28F 1/325 165/182 |
| 2015/0122471 | A1* | 5/2015 | Lee | F28F 1/32 165/181 |
| 2016/0018168 | A1* | 1/2016 | Urbanski | F28F 1/34 165/159 |
| 2016/0361749 | A1* | 12/2016 | Goto | B21C 37/202 |
| 2017/0248370 | A1* | 8/2017 | Nakamura | B21D 53/08 |
| 2019/0137193 | A1* | 5/2019 | Yoshioka | F28F 1/02 |

* cited by examiner

FINNED TUBE HEAT EXCHANGERS AND METHODS FOR MANUFACTURING SAME

BACKGROUND

Traditionally, tubed heat exchangers include a tube 10 and several heat exchanger fins 20 like those shown in FIGS. 1A-1C. Typically, the fins 20 have a fin portion 22 and generally J-shaped collar portion 24. To attach the fins 20 to the tube 10, several fins 20 are stacked or otherwise positioned together, the tube 10 is inserted into a hole defined by the collar portion 24 of each fin 20, and the tube 10 is expanded radially outward to create an interference fit or friction fit between the collar portions 24 and the tube 10. Referring in particular to FIG. 1A, the tube 10 is conventionally expanded by an expanding bullet 30 or another tube-expanding system. For example, as depicted in FIG. 1A, the tube 10 can have an initial inner diameter $d_{ii}$ and an initial outer diameter $d_{oi}$, and the collar portion 24 of each fin 20 can have an inner diameter that is greater than the initial outer diameter $d_{oi}$ of the tube 10. Also, the bullet 30 can have a diameter $D_b$ that is greater than the initial inner diameter $d_{ii}$. Once the fins 20 are stacked and the tube 10 is inserted into the holes defined by the collar portions 24, the expanding bullet 30 can be passed through the interior of the tube 10 with sufficient force to expand the wall of the tube 10 radially outward. Thus, the inner diameter of the tube 10 can be expanded to an increased final inner diameter $d_{if}$ (which is approximately equal to the bullet 30's diameter $D_b$), and the outer diameter of the tube 10 can expanded to an increased final outer diameter $d_{of}$, which can create the interference fit or friction fit between the external surface of the tube 10 and the collar portion 24 of each fin 20. In creating the interference fit or friction fit between the external surface of the tube 10 and the collar portion 24 of each fin 20, each collar portion 24 is moved radially outward from the center of the opening created by the collar portion 24.

While FIG. 1A illustrates an example mechanical expansion process using the bullet 30, similar effects can be achieved by pneumatic expansion of the tube 10, in which a fluid is inserted into the interior of the tube 10. The pressure of the fluid inside the tube 10 is increased to a pressure that is greater than the pressure of the exterior of the tube 10 (e.g., ambient pressure) such that the wall of the tube 10 expands radially outward.

Although widely used in the manufacturing of heat exchangers, this practice is not without faults. For example, after expansion of the tube 10, only a small portion of the generally J-shaped collar portion 24 is in contact with the tube 10, as illustrated by FIG. 1C. Because the surface contact between the fin 20 and the tube 10 is very small, there is limited heat transfer between the tube 10 and the fin 20, which can negatively impact the heat transfer of the exchanger and the overall efficiency of the system including the heat exchanger.

SUMMARY

These and other problems are be addressed by the technologies described herein. Examples of the present disclosure relate generally to heat exchangers and, more specifically, to heat exchanger fin designs for increased heat transfer between a tube the fin.

The disclosed technology includes a heat exchanger fin comprising a fin portion and a collar portion. The collar portion can define a fin aperture that has a central axis passing therethrough, and the collar portion can comprise a nesting end and a receiving end. The nesting end can include a nesting portion. The receiving end can be located apart from the first end in an axial direction, and/or the receiving can comprise one or more bends to form an overhang portion that defines a gap. The gap can be located radially inward of the overhang portion, and the gap can being dimensioned to at least partially receive the nesting portion. The collar portion can include a contact portion extending between the nesting end and the receiving end, and the contact portion can be configured to abut an outer surface of a tube when the tube is at least partially inserted into the fin aperture.

The overhang portion can be configured to inhibit radially outward deformation or movement of at least a portion of an adjacent fin.

The nesting portion can have a radial dimension, and the gap can have a radial dimension that is less than or equal to the radial dimension of the nesting portion.

The gap can radially extend between the overhang portion and the outer surface of the tube when the tube is at least partially inserted into the fin aperture.

The one or more bends of the receiving end can comprise a first bend and a second bend, the overhang portion can comprise the first and second bends and an axially-extending portion extending between the first and second bends, and/or at least a portion of the axially-extending portion can be located at a radially outward position as compared to the contact portion.

The receiving end can comprise a single bend.

The nesting end can comprise a bend and an extending portion.

The bend of the nesting end can be less than approximately 180 degrees, and/or the extending portion can extend radially outward from the bend of the nesting end.

The bend of the nesting end can be between approximately 90 degrees and approximately 180 degrees, and/or the extending portion can extend at least partially in an axial direction.

The extending portion can be concavely curved.

The nesting end can be rounded, and/or the receiving end can be rounded.

At least a portion of the receiving end can be spaced apart from the fin portion in a first axial direction, and at least a portion of the nesting end can be spaced apart from the fin portion in a second axial direction. The second axial direction can be opposite the first axial direction.

The disclosed technology includes a heat exchanger comprising a heat exchanger tube and a plurality of stacked heat exchanger fins. Each of the stacked heat exchanger fins can comprise a fin portion and a collar portion. The collar portion can define a fin aperture having a central axis. The heat exchanger tube can pass through the fin aperture. The collar portion can comprise a nesting end and a receiving end. The nesting end can include a nesting portion. The receiving end can be located apart from the nesting end in an axial direction, and/or the receiving end can comprise one or more bends to form an overhang portion. The overhang portion can define a gap that radially extends between the overhang portion and an outer surface of the heat exchanger tube. The gap can be dimensioned to at least partially receive the nesting portion of an adjacent heat exchanger fin. The collar portion can include a contact portion extending between the nesting end and the receiving end, and the contact portion can abut the outer surface of the heat exchanger tube.

The overhang portion of each heat exchanger fin can be configured to inhibit radially outward deformation or movement of at least a portion of an adjacent fin.

The nesting portion of each heat exchanger fin can have a radial dimension, and the gap of each heat exchanger fin can have a radial dimension that is less than or equal to the radial dimension of the nesting portion.

The one or more bends of the receiving end can comprise a first bend and a second bend, the overhang portion can comprise the first and second bends and an axially-extending portion extending between the first and second bends, and/or at least a portion of the axially-extending portion can be located at a radially outward position as compared to the contact portion.

At least a portion of the receiving end can be spaced apart from the fin portion in a first axial direction, and/or at least a portion of the nesting end can be spaced apart from the fin portion in a second axial direction, the second axial direction being opposite the first axial direction.

The disclosed technology includes a heat exchanger fin comprising a fin portion and a collar portion defining a fin aperture that has a central axis. The collar portion can comprise a first end and a second end. The first end can be proximate the fin portion. The second end can be spaced apart from the first end in an axial direction. The second end can comprise a protrusion. The collar portion can comprise a contact portion extending between the first end and the second end, and the contact portion can be configured to abut an outer surface of a tube when the tube is at least partially inserted into the fin aperture. The fin can include a receiving aperture dimensioned to at least partially receive the protrusion. The fin can be located on the collar portion or the fin portion.

The receiving aperture can be configured to at least partially receive a protrusion of an adjacent fin and the can be configured to inhibit radially outward deformation or movement of at least a portion of the adjacent fin.

Further features of the disclosed design, and the advantages offered thereby, are explained in greater detail hereinafter with reference to specific examples illustrated in the accompanying drawings, wherein like elements are indicated be like reference designators.

BRIEF DESCRIPTION OF THE DRAWINGS

Reference will now be made to the accompanying drawings, which are not necessarily drawn to scale. The drawings are incorporated into and constitute a portion of this disclosure, illustrating various implementations and aspects of the disclosed technology. Together with the description, the drawings serve to explain the principles of the disclosed technology.

DETAILED DESCRIPTION

Figure 1A:
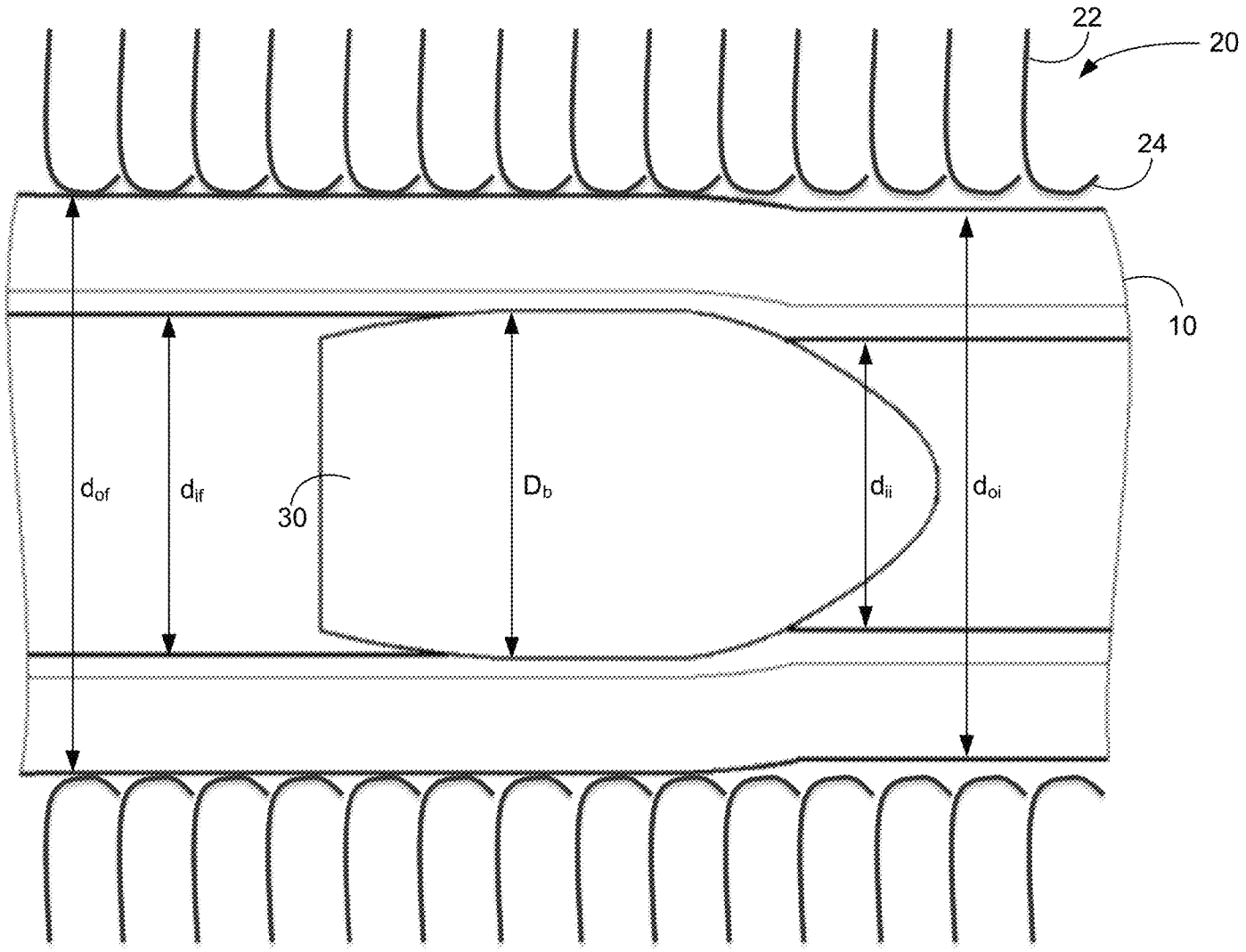
FIG. 1A PRIOR ART
FIG. 1A illustrates a cross-sectional schematic view of a bullet mechanically expanding a heat exchanger tube to contact J-shaped fin collars, in accordance with the prior art.
Figure 1B:
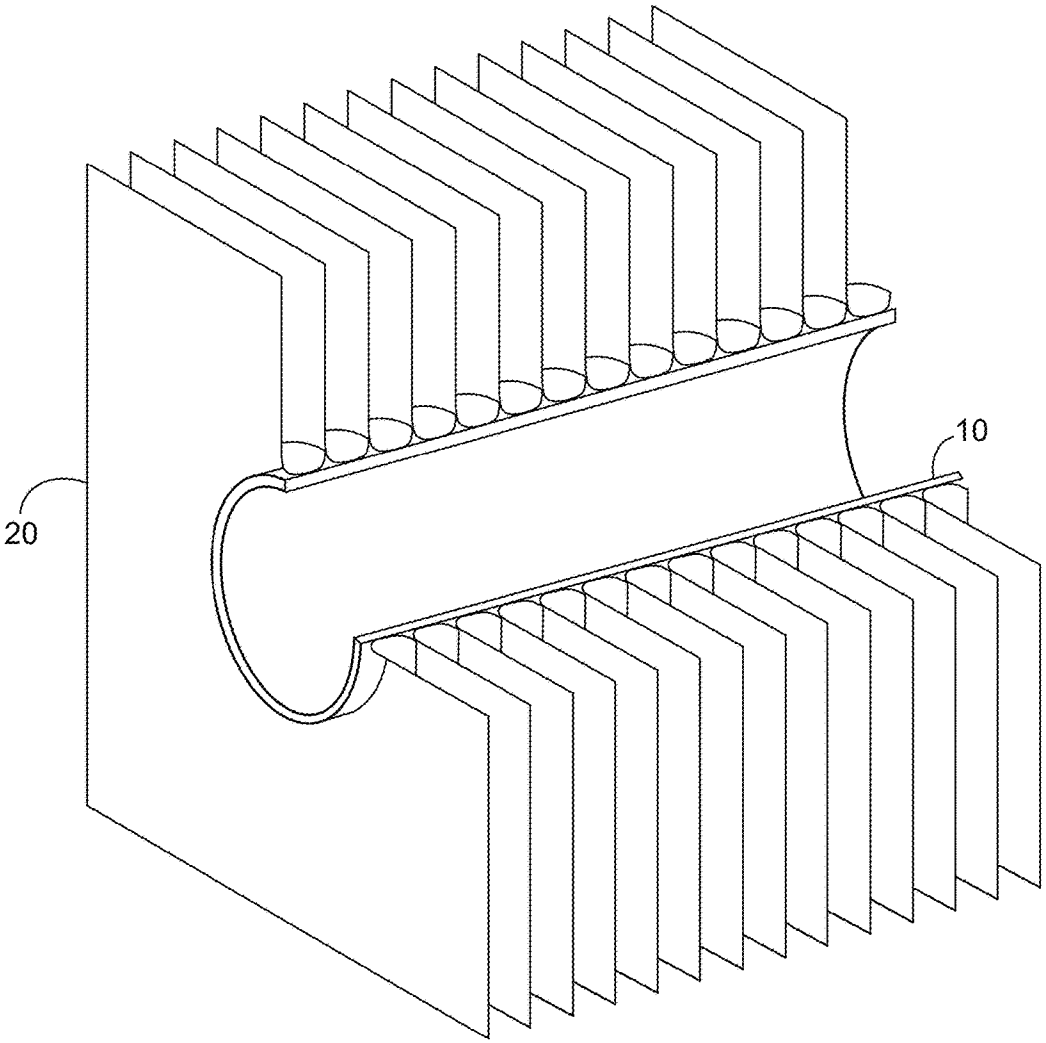
FIG. 1B PRIOR ART
FIG. 1B illustrates a partial cross-sectional view of a heat exchanger tube with fins having J-shaped fin collars, in accordance with the prior art.

Throughout this disclosure, systems and methods are described with respect to pressure expanding a tube to fit a heat exchanger fin. Those having skill in the art will recognize that the disclosed technology can be applicable to multiple scenarios and applications.

Some implementations of the disclosed technology will be described more fully with reference to the accompanying drawings. This disclosed technology may, however, be embodied in many different forms and should not be construed as limited to the implementations set forth herein. The components described hereinafter as making up various elements of the disclosed technology are intended to be illustrative and not restrictive. Indeed, it is to be understood that other examples are contemplated. Many suitable components that would perform the same or similar functions as components described herein are intended to be embraced within the scope of the disclosed electronic devices and methods. Such other components not described herein may include, but are not limited to, for example, components developed after development of the disclosed technology.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

Unless otherwise specified, all ranges disclosed herein are inclusive of stated end points, as well as all intermediate values. By way of example, a range described as being "from approximately 2 to approximately 4" includes the values 2 and 4 and all intermediate values within the range. Likewise, the expression that a property "can be in a range from approximately 2 to approximately 4" (or "can be in a range from 2 to 4") means that the property can be approximately 2, can be approximately 4, or can be any value therebetween. Further, the expression that a property "can be between approximately 2 and approximately 4" is also inclusive of the endpoints, meaning that the property can be approximately 2, can be approximately 4, or can be any value therebetween.

It is to be understood that the mention of one or more method steps does not preclude the presence of additional method steps or intervening method steps between those steps expressly identified. Similarly, it is also to be understood that the mention of one or more components in a device or system does not preclude the presence of additional components or intervening components between those components expressly identified.

As used herein, unless otherwise specified, the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

Although the disclosed technology may be described herein with respect to various systems and methods, it is contemplated that embodiments or implementations of the disclosed technology with identical or substantially similar features may alternatively be implemented as methods or systems. For example, any aspects, elements, features, or the like described herein with respect to a method can be equally attributable to a system. As another example, any aspects, elements, features, or the like described herein with respect to a system can be equally attributable to a method.

Reference will now be made in detail to example embodiments of the disclosed technology, examples of which are illustrated in the accompanying drawings and disclosed herein. Wherever convenient, the same reference numbers will be used throughout the drawings to refer to the same or like parts.

Figure 1C:
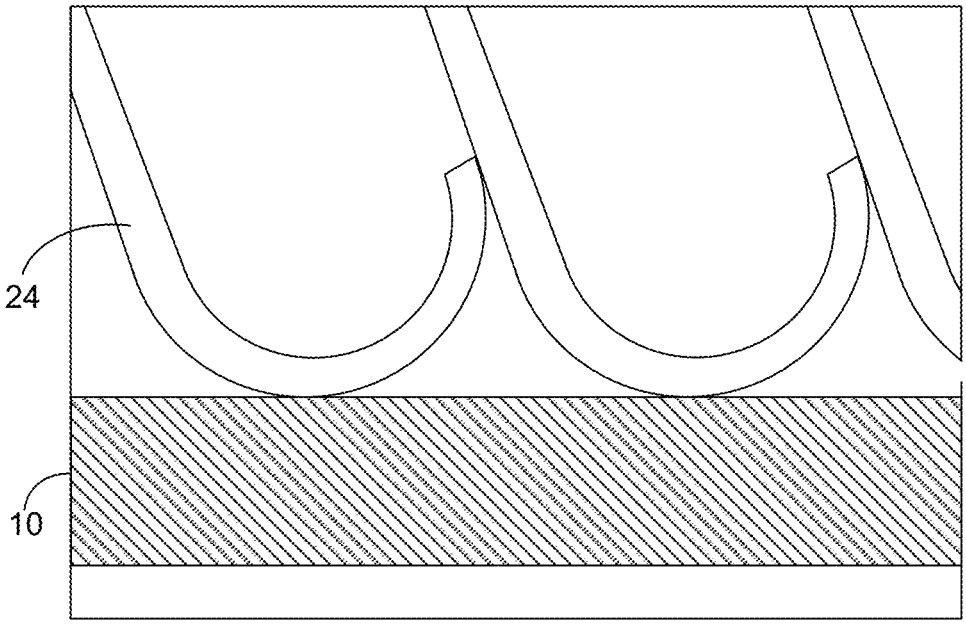
FIG. 1C PRIOR ART
FIG. 1C illustrates an enlarged cross-sectional view of J-shaped fin collars contacting an enlarged heat exchanger tube, in accordance with the prior art.

As discussed, existing designs generally include a J-shaped fin collar or collar portion 24. To attach the fin 20 to a tube 10, the tube 10 is inserted into a hole defined by the collar portion 24, and the tube 10 is then expanded radially outward to create a friction fit between the outer surface of the tube 10 and the collar portion 24 of the fin 20. However, conventional fin designs have a J-shaped collar portion 24, which results in only a small portion of the collar portion 24—typically near the apex of the J-shape—maintaining contact with the tube 10, as shown in FIG. 1C. Because of this limited surface contact between the fin 20 and the tube 10, heat transferability and heat exchanger performance is limited.

As will appreciated, a conventional, J-shaped fin 20 has a fin portion 22 that extends generally radially outward from a center of the hole defined by the collar portion 24 (and a central axis of the tube 10 once the fin 20 and the tube 10 are friction fitted). Typically, the collar portion 24 bends from the generally radial direction of the fin portion 22 and to a generally axial direction, as determined with respect to the central axis of the tube 10 when the fin 20 and the tube 10 are connected. That is, the collar portion 24 bends from the generally radial direction to a direction that is at least partially perpendicular to the generally radially outward direction (i.e., the generally axial direction). To complete the J-shape, the collar portion 24 typically continues to bend from the generally axial direction to a direction of the collar portion 24's terminal end, which is an at least partially radial direction. The J-shape can include one continuous bend that extends (i) from the generally radial direction of the fin portion 22 to the generally axial direction and (ii) from the generally axial direction to the generally radial direction of the terminal end of the collar portion 24. Alternatively, the J-shape can include two distinct bends, with the first bend extending from the generally radial direction of the fin portion 22 to the generally axial direction and the second bend extending from the generally axial direction to the generally radial direction of the terminal end of the collar portion 24.

As will be appreciated, as the tube 10 is expanded, the J-shaped collar portion 24 of the fin 20 is pushed radially outward, which can exacerbate the angle of the bend from the generally radial direction of the fin portion 22 to the generally axial direction. This can, in turn, decrease the length of the collar portion 24 that is extending in the generally axial direction, which results in decreased surface contact between the collar portion 24 and the tube 10. Moreover, for bullet expansion, the bullet can deform the tube 10 radially outward and axially in the direction the direction of the bullet's insertion. Without good contact between adjacent fins 20, the collar portion 24 of existing fins 20 can also shift in the axial direction, which can also contribute to decreased contact between the collar portion 24 and the tube 10.

The disclosed technology includes fins having collar portions that provide increased surface contact with the heat exchanger tube, which can provide increased heat transferability and/or increased and heat exchanger performance.

Figure 2B:
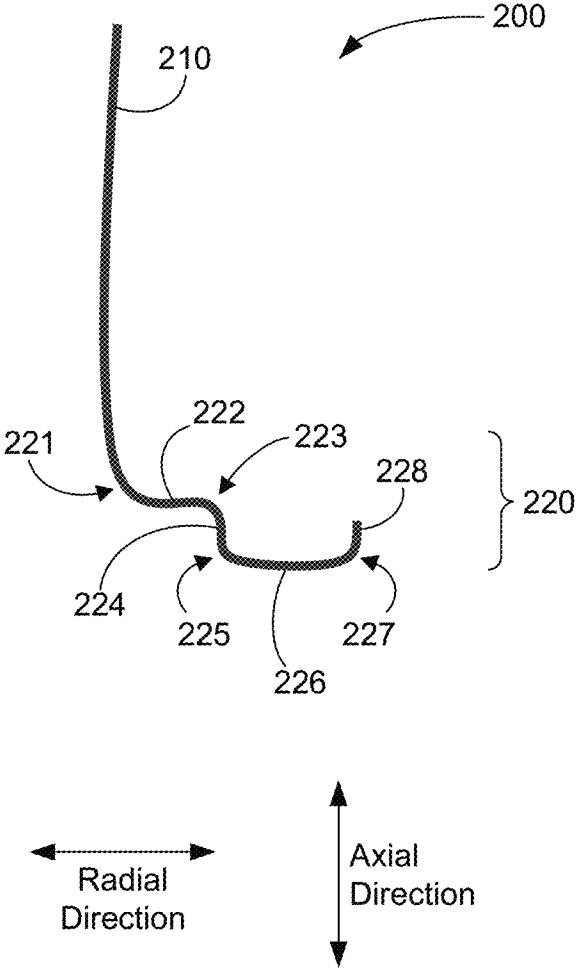
FIG. 2B illustrates a partial cross-sectional view of the example fin illustrated in FIG. 2A, in accordance with the disclosed technology.
Figure 2A:
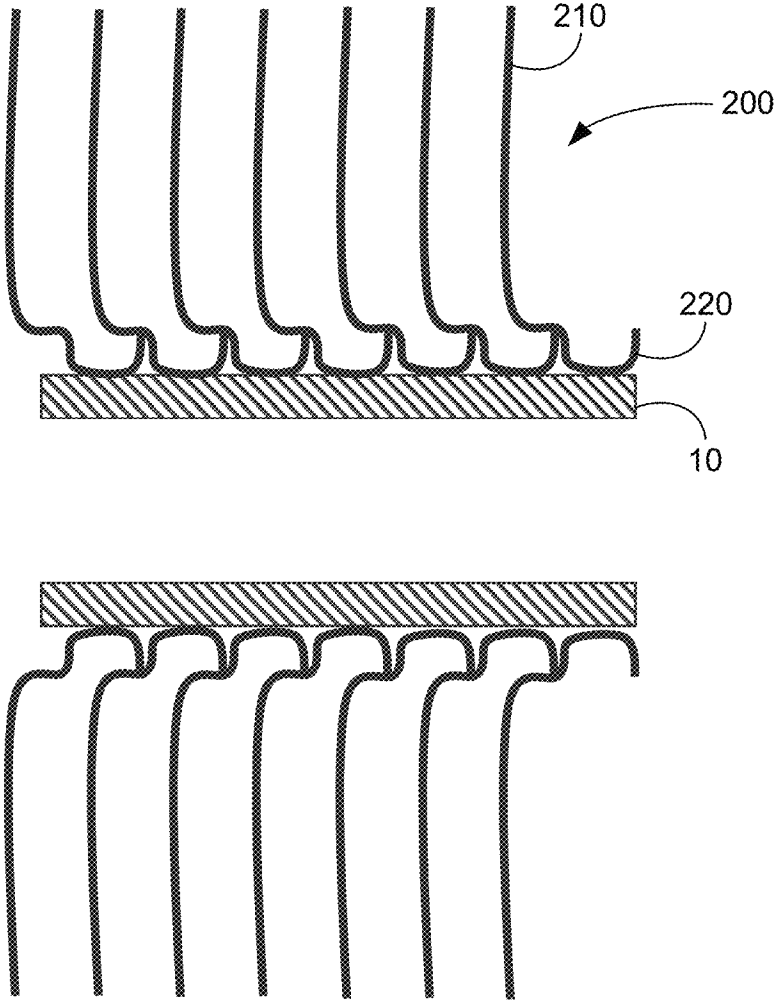
FIG. 2A illustrates a cross-sectional view of example fins attached to a tube, in accordance with the disclosed technology.
Figure 2C:
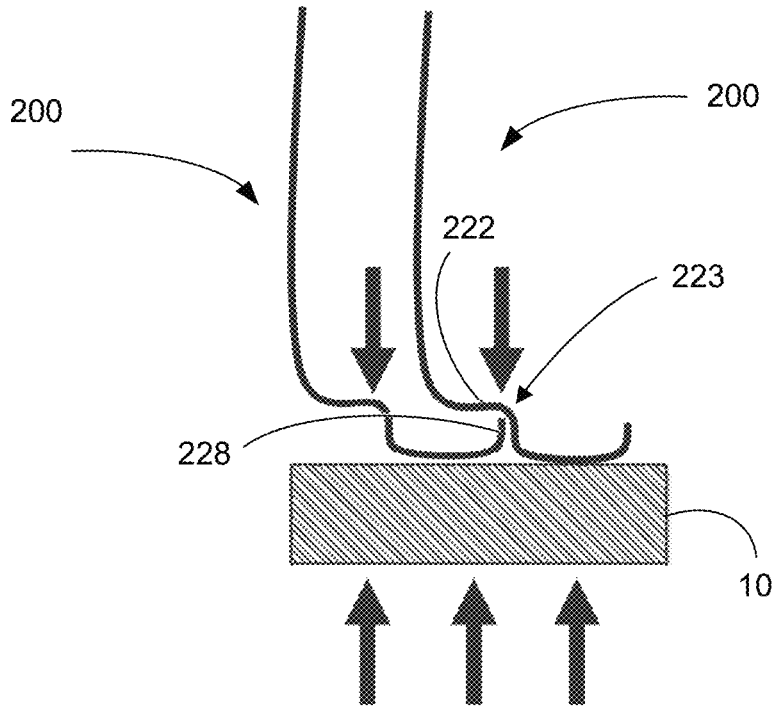
FIG. 2C illustrates forces associated with example fins during tube expansion, in accordance with the disclosed technology.

Referring to FIGS. 2A-2C, a fin 200 can include a fin portion 210 and a collar portion 220. As will be appreciated, the fin portion 210 can be a substantially planar portion extending radially outward from the collar portion 220 (e.g., similar to the fin portion 20). The collar portion 220 can define a central aperture of the fin 200, through which a tube 10 can be inserted.

As shown most clearly in FIG. 2B, the collar portion 220 can include a first bend 221, a second bend 223, a third bend 225, and/or a fourth bend 227. A first portion 222 can extend between the first bend 221 and the second bend 223, and the first portion 222 can extend in a generally axial direction. A second portion 224 can extend between the second bend 223 and the third bend 225, and the second portion 224 can extend in a generally radial direction. A third portion 226 can extend between the third bend 225 and the fourth bend 227, and the third portion 226 can extend in a generally axial direction. A fourth portion 228 can extend from the fourth bend 227 (e.g., to a terminal end of the collar portion 220), and the fourth portion 228 can extend in a generally radial direction (e.g., radially outward from the fourth bend 227).

All or some of the first portion 222 can be located at a position that is radially outward as compared to a position of some or all of the third portion 226. Alternatively or in addition, the fourth portion 228 can have a terminal end located at a radial position that is less than or approximately equal to an inner surface of the first portion 222 (e.g., a portion of the first portion 222 that is proximate the first bend 221, a central portion of the first portion 222 located near a midsection of the first portion 222, a portion of the first portion that is proximate the second bend 223). Thus, adjacent fins 200 can be stacked by, for example, nesting the fourth portion 228 at a radially inward position relative the first portion 221.

As explained, one of the shortcomings of existing fin designs (e.g., fin 20) is that the terminal end of the collar 24 is free to move in the radial direction such that, when the tube 10 is expanded radially outward, the terminal end of the collar 24 is typically pushed radially outward, as well. Stated otherwise, as a result of the tube expansion process, the portion of the collar 24 contacting the outer surface of the tube 10 typically has a curved shape (e.g., "J-shape") rather than a flat bottom, resulting in decreased surface contact between the fin 20 and the tube 10.

In contrast, the disclosed technology (e.g., fin 200) can provide a surface to resist radially outward deformation of the collar portion (e.g., collar portion 220). For example, referring to FIG. 2C, the first portion 222 and/or the second bend 223 can serve to resist deformation of the collar portion 220 of an adjacent fin 200. That is, in this example, when the tube is expanded radially outward (denoted by the arrows pointed upward in FIG. 2C), a first fin 200 can resist deformation (denoted by the arrows pointing downward in FIG. 2C, representing a radially inward direction) of the collar portion 220 of an adjacent fin 200 having its terminal end nested radially inward of the first portion 222 and/or the second bend 223 of the first fin 200.

Figure 3B:
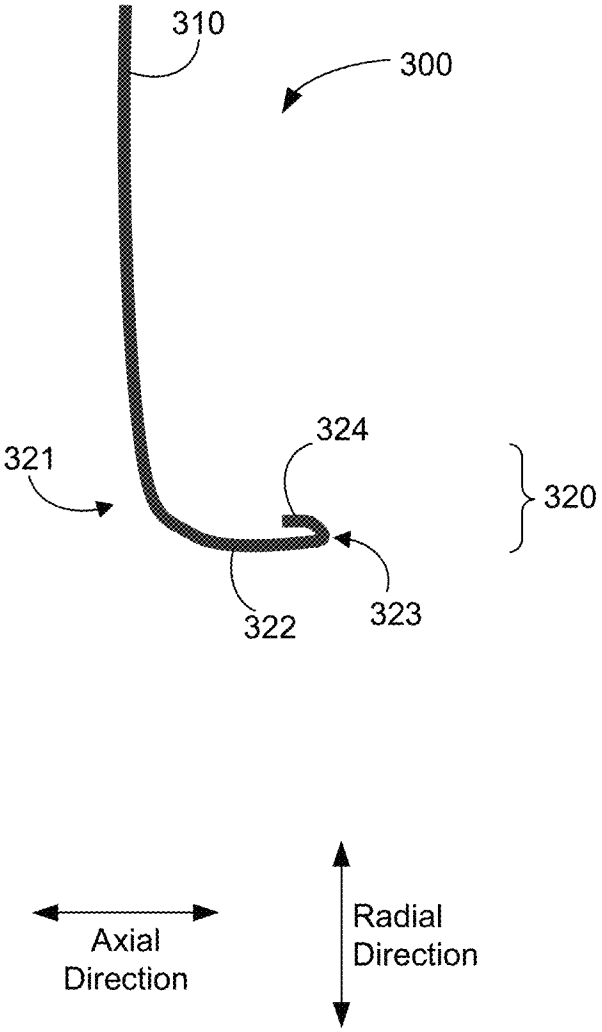
FIG. 3B illustrates a partial cross-sectional view of the example fin illustrated in FIG. 3A, in accordance with the disclosed technology.
Figure 3A:
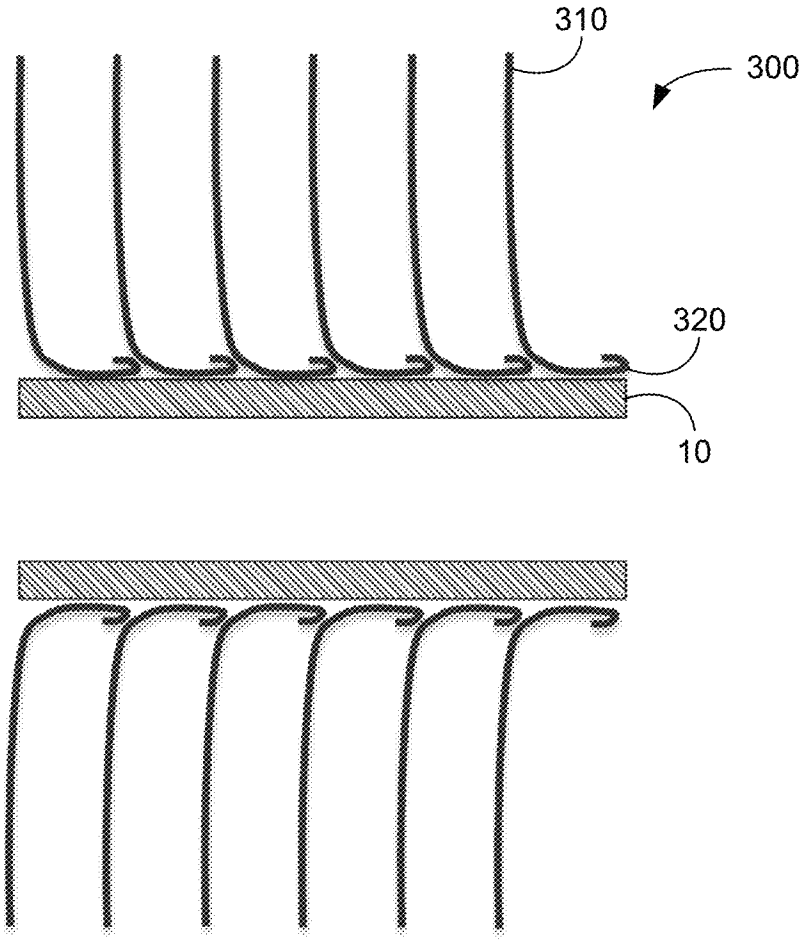
FIG. 3A illustrates a cross-sectional view of example fins attached to a tube, in accordance with the disclosed technology.

Referring now to FIGS. 3A and 3B, the disclosed technology includes a fin 300 can include a fin portion 310 and a collar portion 320. The fin portion 310 can be a substantially planar portion extending radially outward from the collar portion 320 (e.g., similar to the fin portion 20). The collar portion 320 can define a central aperture of the fin 300, through which a tube 10 can be inserted.

Referring in particular to FIG. 3B, the collar portion 320 can include a first bend 321 and a second bend 323. A first portion 322 can extend between the first bend 321 and the second bend 323. The first bend can be approximately 90 degrees such that first portion 322 is approximately perpendicular to the fin portion 310. Alternatively or in addition, the first portion 322 can extend in a generally axial direction. The second bend 323 can be greater than approximately 90 degrees (i.e., as measured from the outer surface of the second bend 323). For example, the second bend 323 can be approximately 180 degrees. Alternatively or in addition, the second bend 323 can be less than approximately 180 degrees. For example, the second bend 323 can be in the range from approximately 90 degrees to approximately 120 degrees. Alternatively, the second bend 323 can be in the range from approximately 120 degrees to approximately 150 degrees. Alternatively, the second bend 323 can be in the range from approximately 150 degrees to approximately 180 degrees. The collar portion 320 can include a second portion 324 extending from the second bend 323. The second portion 324 can extend from the second bend 323 to a terminal end of the collar portion 320.

All or some of the first portion 322 can be located at a position that is radially inward as compared to a position of some or all of the second portion 324. Optionally, the second portion 324 can at least partially fold over the first portion 322 at a position that is radially outward as compared to the first portion 322. The second portion 324 can be configured to at least partially nest under (i.e., radially inward of) at least some of the first bend 321. This can enable adjacent fins 300 to be easily stacked.

Figure 4B:
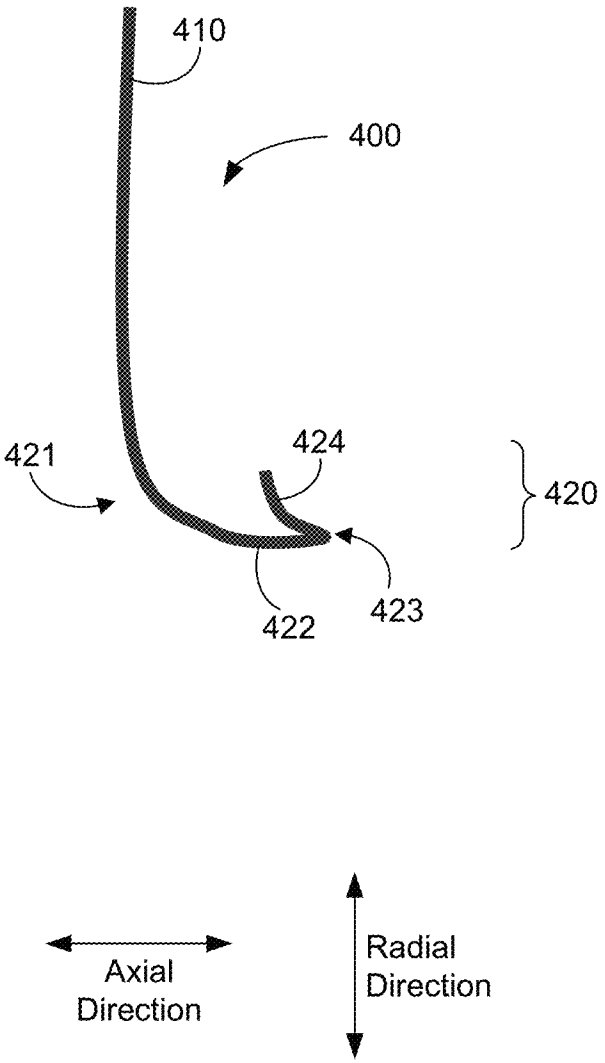
FIG. 4B illustrates a partial cross-sectional view of the example fin illustrated in FIG. 4A, in accordance with the disclosed technology.
Figure 4A:
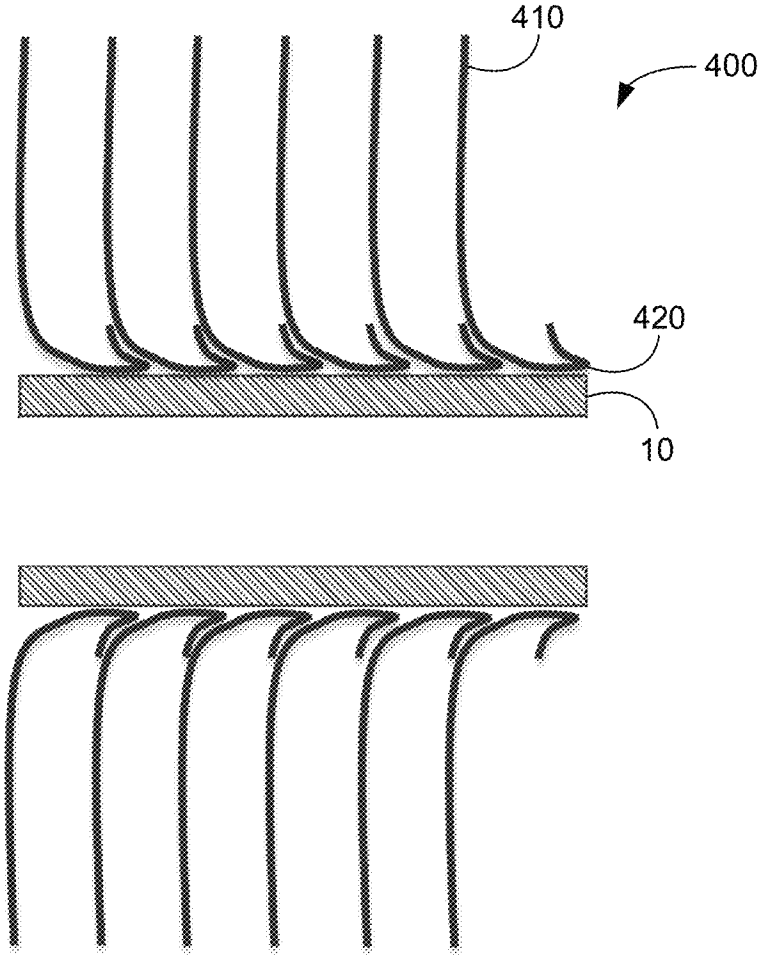
FIG. 4A illustrates a cross-sectional view of example fins attached to a tube, in accordance with the disclosed technology.

Similarly, as shown in FIGS. 4A and 4B, the disclosed technology includes a fin 400 can include a fin portion 410 and a collar portion 420. The fin portion 410 can be a substantially planar portion extending radially outward from the collar portion 420 (e.g., similar to the fin portion 20). The collar portion 420 can define a central aperture of the fin 400, through which a tube 10 can be inserted.

Referring in particular to FIG. 4B, the collar portion 420 can include a first bend 421 and a second bend 423. A first portion 422 can extend between the first bend 421 and the second bend 423. The first bend can be approximately 90 degrees such that first portion 422 is approximately perpendicular to the fin portion 410. Alternatively or in addition, the first portion 422 can extend in a generally axial direction. The second bend 423 can be greater than approximately 90 degrees (i.e., as measured from the outer surface of the second bend 423). For example, the second bend 423 can be approximately 180 degrees. Alternatively or in addition, the second bend 423 can be less than approximately 180 degrees. For example, the second bend 423 can be in the range from approximately 90 degrees to approximately 120 degrees. Alternatively, the second bend 423 can be in the range from approximately 120 degrees to approximately 150 degrees. Alternatively, the second bend 423 can be in the range from approximately 150 degrees to approximately 180 degrees. The collar portion 420 can include a second portion 424 extending from the second bend 423. The second portion 424 can be concavely curved (e.g., to mate with the first bend 321 of an adjacent fin 400), as shown in FIG. 4B. Alternatively, the second portion 424 can be convexly curved. Alternatively, the second portion 424 can be substantially straight. The second portion 424 can extend from the second bend 423 to a terminal end of the collar portion 420. The terminal end of the second portion 424 can be a radially outward position relative the opposite end of the second portion 424 (i.e., proximate the second bend 423). That is, the second portion 424 can optionally extend in an at least partially radial direction.

All or some of the first portion 422 can be located at a position that is radially inward as compared to a position of some or all of the second portion 424. Optionally, the second portion 424 can at least partially fold over the first portion 422 at a position that is radially outward as compared to the first portion 422. The second portion 424 can be configured to at least partially nest under (i.e., radially inward of) at least some of the first bend 421. This can enable adjacent fins 400 to be easily stacked.

Figure 5B:
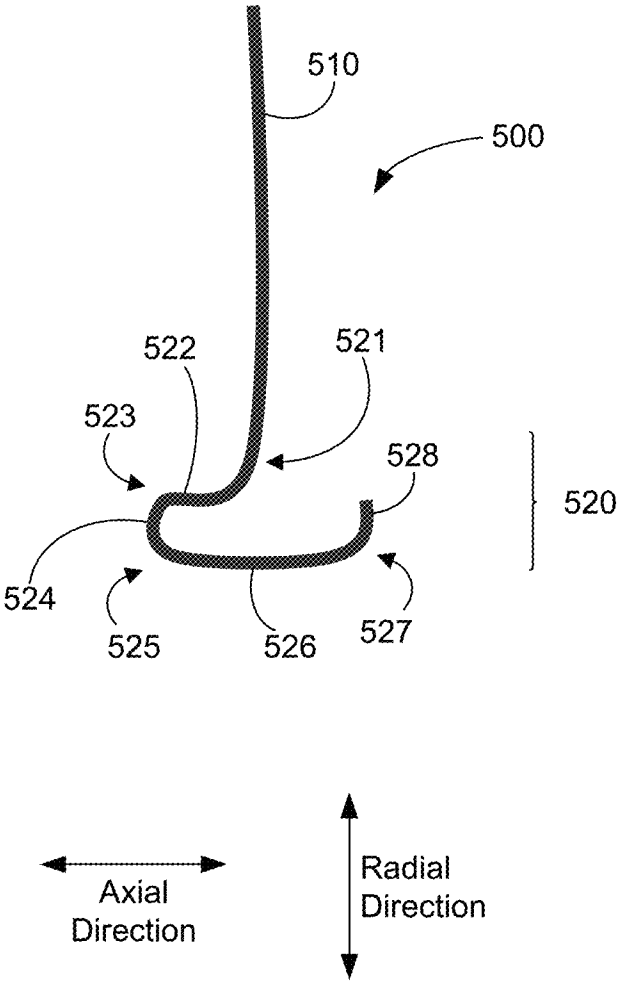
FIG. 5B illustrates a partial cross-sectional view of the example fin illustrated in FIG. 5A, in accordance with the disclosed technology.
Figure 5A:
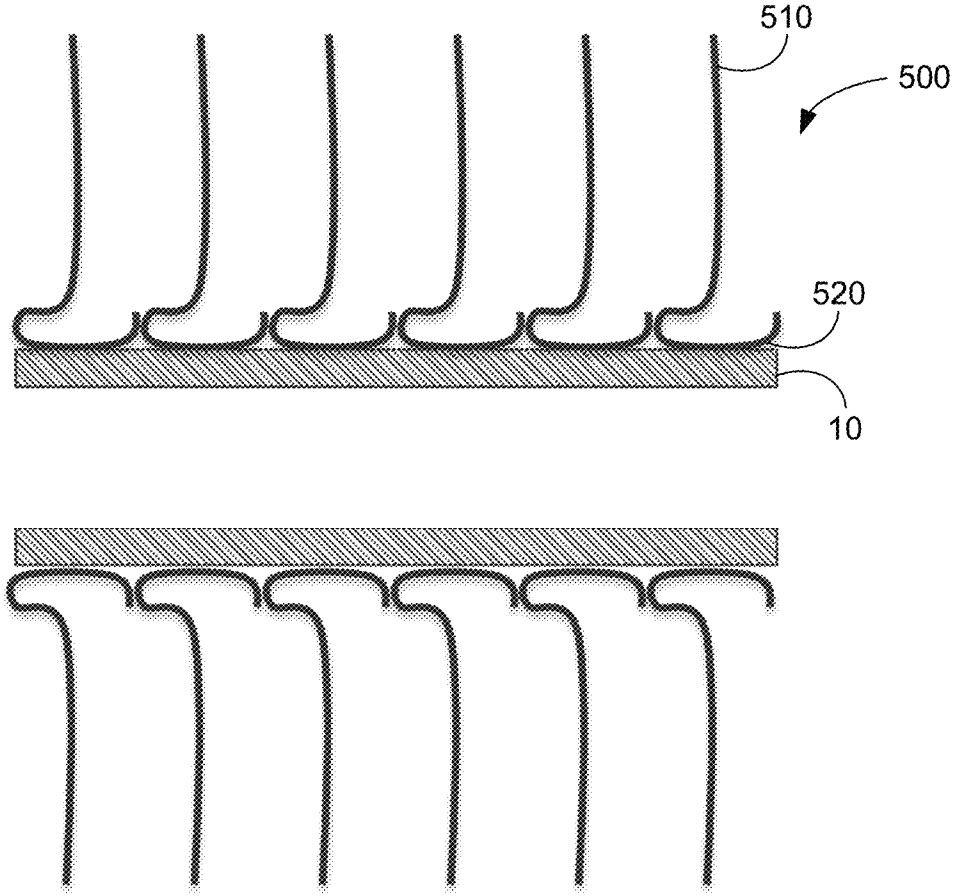
FIG. 5A illustrates a cross-sectional view of example fins attached to a tube, in accordance with the disclosed technology.

Referring now to FIGS. 5A and 5B, the disclosed technology includes a fin 500 can include a fin portion 510 and a collar portion 520. The fin portion 510 can be a substantially planar portion extending radially outward from the collar portion 520 (e.g., similar to the fin portion 20). The collar portion 520 can define a central aperture of the fin 500, through which a tube 10 can be inserted.

Referring in particular to FIG. 5B, the collar portion 520 can include a first bend 521 extending in a first generally axial direction. A first portion 522 can extend between the first bend 521 and a rounded end. The rounded end can include a second bend 523 and a third bend 525 and a second portion extending between the second bend 523 and the third bend 525. A third portion 526 can extend from the rounded end in a second generally axial direction. The second axial direction can be approximately opposite the first axial direction. Alternatively, the rounded end can be a single bend configured to bend approximately 180 degrees from the first portion 522 to the third portion 526. Optionally, the fin portion 510 can be configured to overhang at least some of the third portion 526 (i.e., the fin portion 510 can be located at a position that is directly radially outward as compared to the third portion 526).

Optionally, the third portion 526 can extend from the rounded end to a fourth bend 527. A fourth portion 528 can optionally extend from the fourth bend 527. The fourth bend 527 can be configured to be approximately 90 degrees (e.g., such that the fourth portion 528 can extend in a generally radial direction). Alternatively, the fourth bend 527 can be less than 90 degrees (e.g., such that the fourth portion 528 can extend in generally in the second axial direction). Alternatively, the fourth bend 527 can be greater than 90 degrees (e.g., such that the fourth portion 528 can extend in generally in the first axial direction).

The collar portion 520 can include a second end that is opposite the rounded end in a radial direction. The second end can include an end of the third portion 526, the fourth bend 527, and/or the fourth portion 528. All or some of the rounded end can be located at a position that is configured to abut the second end of an adjacent fin 500 and/or creates an overhang defining a gap that is configured to receive at least a portion of the second end of the adjacent fin 500, which can enable adjacent fins 500 to be easily stacked.

Figure 6B:
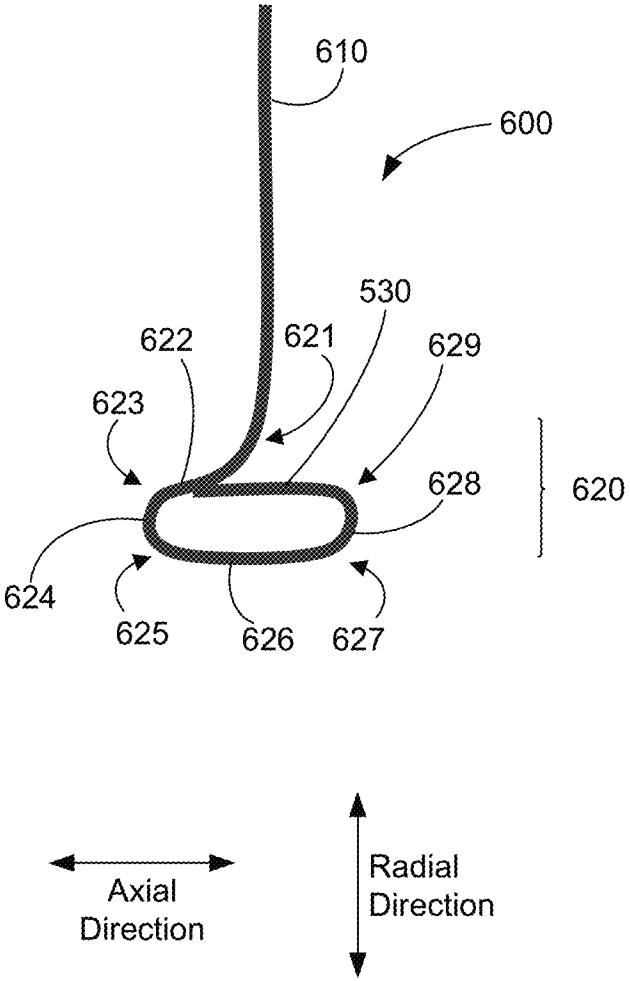
FIG. 6B illustrates a partial cross-sectional view of the example fin illustrated in FIG. 6A, in accordance with the disclosed technology.
Figure 6A:
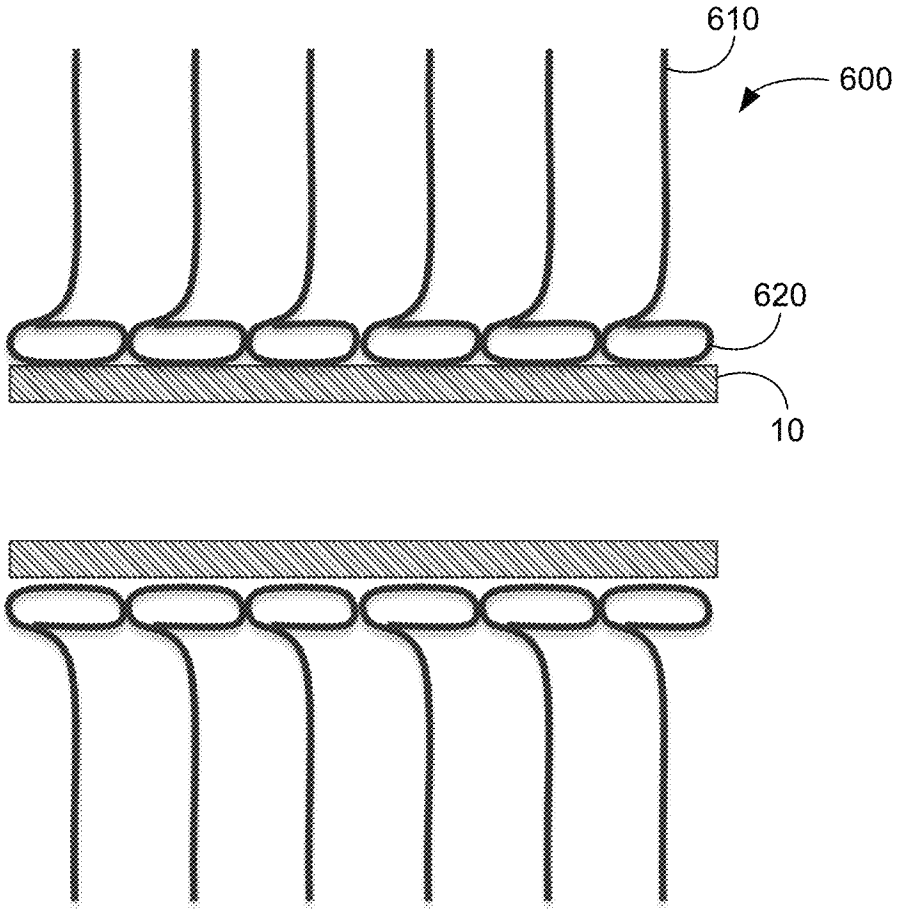
FIG. 6A illustrates a cross-sectional view of example fins attached to a tube, in accordance with the disclosed technology.

Referring now to FIGS. 6A and 6B, the disclosed technology includes a fin 600 can include a fin portion 610 and a collar portion 620. The fin portion 610 can be a substantially planar portion extending radially outward from the collar portion 620 (e.g., similar to the fin portion 20). The collar portion 620 can define a central aperture of the fin 600, through which a tube 10 can be inserted.

Referring in particular to FIG. 6B, the collar portion 620 can include a first bend 621 extending in a first generally axial direction. A first portion 622 can extend between the first bend 621 and a first rounded end. The first rounded end can include a second bend 623 and a third bend 625 and a second portion extending between the second bend 623 and the third bend 625. A third portion 626 can extend from the first rounded end in a second generally axial direction. The second axial direction can be approximately opposite the first axial direction. Alternatively, the first rounded end can be a single bend configured to bend approximately 180 degrees from the first portion 622 to the third portion 626.

The third portion 626 can extend from the first rounded end to a second rounded end. The second rounded end can include a fourth bend 627 and a fifth bend 629 and a fourth portion 628 can extend between the fourth bend 627 and the fifth bend 629. A fifth portion 630 can extend from the fifth bend 629. Alternatively, the second rounded end can be a single bend configured to bend approximately 180 degrees from the third portion 626 to the fifth portion 630. The fifth portion 630 can optionally abut another portion of collar portion 620 and/or a portion of the fin portion 610. The fifth portion 630 can be at a position that is radially outward as compared to the third portion 626. Optionally, the fin portion 610 can be configured to overhang at least some of the third portion 626 and/or at least some of the fifth portion 630 (i.e., the fin portion 610 can be located at a position that is directly radially outward as compared to the third portion 626 and/or the fifth portion 630).

The first rounded end can be located at a position that is configured to abut the second rounded end of an adjacent fin 600 and/or to create an overhang defining a gap that is configured to receive at least a portion of the second rounded end of the adjacent fin 600, which can enable adjacent fins 600 to be easily stacked.

While the collar portions 520, 620 of the fins 500, 600 shown in FIGS. 5A, 5B, 6A, and 6B may not include overhang portions to resist radial deformation of an adjacent fin 500, 600, these designs position the fin portion 510, 610 at or near the center of the collar portion 520, 620 in the axial direction (i.e., between the two outermost edges of the collar portion 520, 620 in the axial direction). By so positioning the fin portion 510, 610, the movement of the collar portion's 520, 620 free end (i.e., the outermost edge opposite the end of the collar portion 520, 620 that connects to the fin portion 510, 610) is better prevented from deforming in the radial direction.

For example, referring to the fin 600 of FIGS. 6A and 6B, as the tube expands, a resistance force is exerted in the middle of the collar portion 620 by the fin portion 610. This resistance force can be uniformly distributed to the collar portion 620 such that the collar portion 620 can become sandwiched between the outer surface of the tube 10 and the fin portion 610, thereby creating large surface contact between the collar portion 620 of the fin 600 and the outer surface of the tube 10. In contrast, any resistance provided by the fin portion 22 of traditional J-shaped fin designs 20 is present only on the attachment end of the collar portion 24, which permits the free end of the collar portion 24 to move more easily in the radial direction.

Alternatively or in addition to the various nesting capabilities described herein, the disclosed technology includes a fins having a protrusion and an aperture configured to at least partially receive the protrusion of an adjacent fin. For example, referring to FIGS. 7A-7C, a fin 700 can include a fin portion 710 and a collar portion 720. The fin portion 710 can be a substantially planar portion extending radially outward from the collar portion 720 (e.g., similar to the fin portion 20). The collar portion 720 can define a central aperture of the fin 700, through which a tube 10 can be inserted.

Figure 7B:
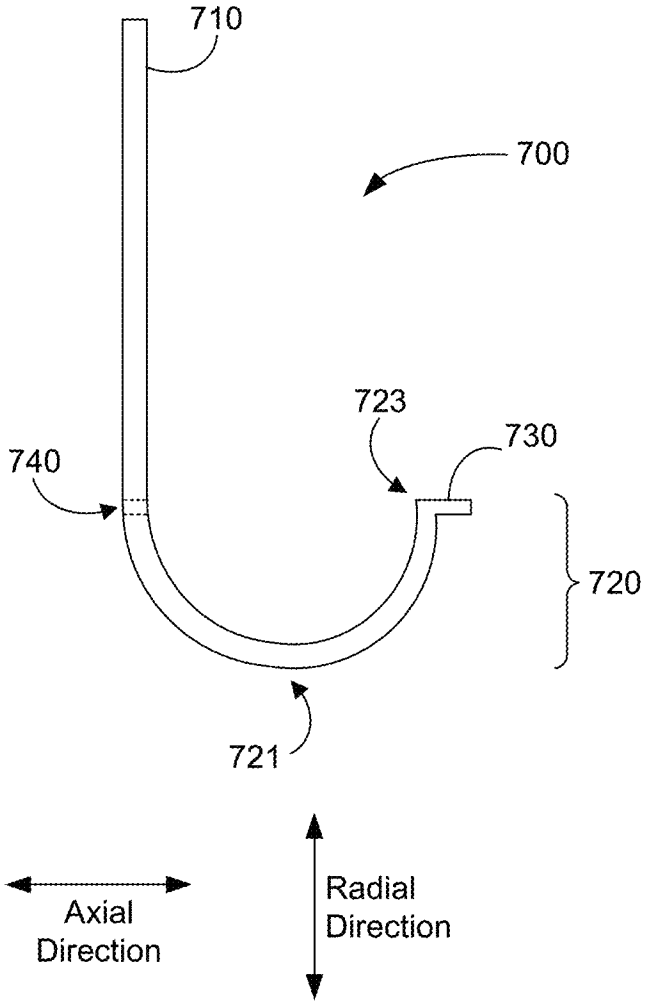
FIG. 7B illustrates a partial cross-sectional view of the example fin illustrated in FIG. 7A, in accordance with the disclosed technology.
Figure 7A:
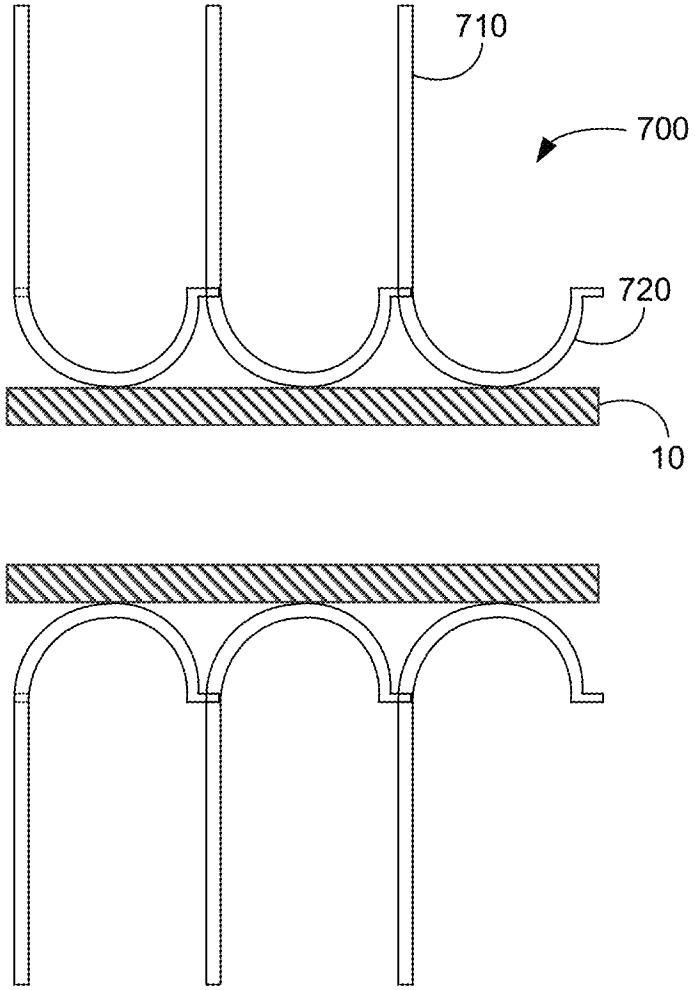
FIG. 7A illustrates a cross-sectional view of example fins attached to a tube, in accordance with the disclosed technology.

Referring to FIG. 7B, in particular, the collar portion 720 can include, for example, a first bend 721. The first bend 721 can be approximately 180 degrees; for example both ends of the first bend 721 can extend in a generally radial direction. At the end of the collar portion 720 that is opposite the fin portion 710, the collar portion 720 can include a protrusion 730. The protrusion 730 can be connected to the first bend 721 via a second bend 723. The protrusion 730 can extend in a generally axial direction, and/or the protrusion 730 can extend away from the fin portion 710 in the generally axial direction. The fin 700 can include an aperture 740, and the aperture 740 can be sized and/or dimensioned to at least partially receive a protrusion of an adjacent fin 700. Thus, the protrusion 730 of a first fin 700 can at least partially insert into an aperture 740 of a second fin 700. The aperture 740 can be located on the collar portion 720 or on the fin portion 710.

The fin 700 can include a plurality of protrusions 730 and a plurality of corresponding apertures 740. The protrusions 730 and corresponding apertures 740 can be positioned circumferentially (e.g., at a common radius). Thus, the fin portion 710 can remain substantially rigid and connected to the collar portion 720, while the apertures 740 can inhibit radially outward deformation of an adjacent fin 700 by way of the apertures 740 aligning with and contacting the adjacent fin 700's corresponding protrusions 730.

Figure 7C:
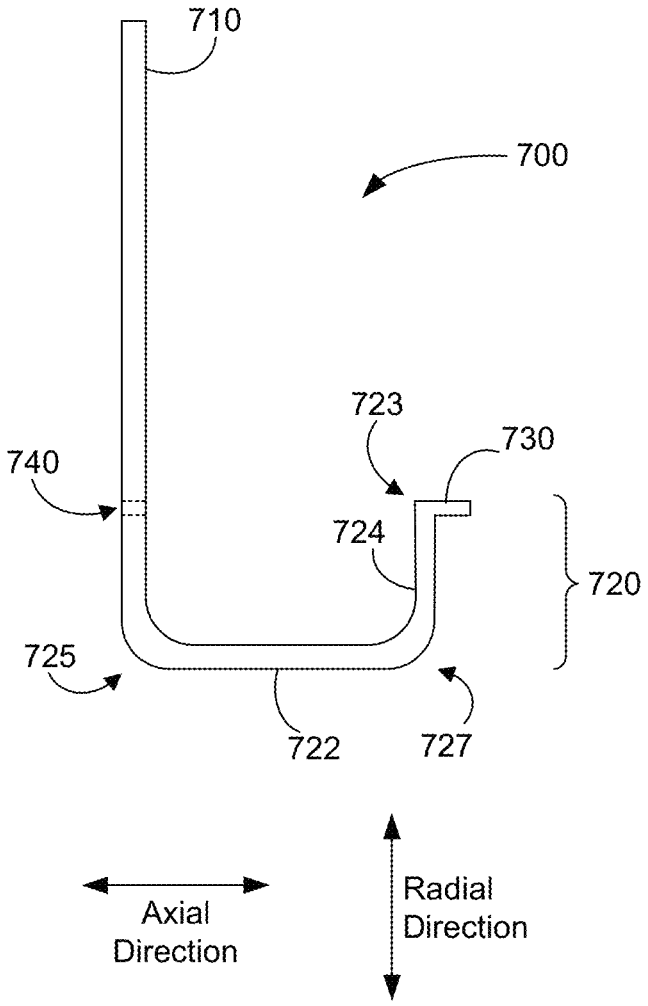
FIG. 7C illustrates a partial cross-sectional view of an example fin, in accordance with the disclosed technology.

While the fin 700 is shown in FIG. 7B as having a generally a J-shape, the disclosed technology is not so limited. For example, instead of the single first bend 721 shown in FIG. 7B, the collar portion 720 can include a third bend 725, a first portion 722, and a fourth bend 727, as shown in FIG. 7C. The third bend 725 and/or the fourth bend 727 can be approximately 90 degrees. The first portion 722 can be substantially flat and/or can extend in a generally axial direction. A second portion 724 can extend between the fourth bend 727 and the second bend 723. The second portion can extend in a generally radial direction. Thus, the fin 700 can have a flattened or blocked J-shape.

Various examples of the disclosed technology have been described herein. As will be appreciated by those having skill in the art, the disclosed technology includes a fin (e.g., fin 200, 300, 400, 500, 600, 700) that provides an overhang portion (or receiving portion) at radially inward position relative the fin portion (e.g., fin portion 210, 310, 410, 510, 610, 710). The overhang portion can be located on a receiving end of the collar portion (e.g., collar portion 220, 320, 420, 520, 620, 720). The overhang portion can create a generally radially extending gap into which at least some of the collar portion can be positioned when adjacent fins are stacked. The receiving end of the collar portion can be opposite a nesting end of the collar portion (e.g., in the axial direction). The nesting end can include a nesting portion that is dimensioned to fit inside the gap created by the overhang portion. That is, the nesting portion can have a radial dimension that is less than or equal to a radial dimension of the gap created by the overhang portion. The nesting portion can have an axial dimension that is greater than an axial dimension of the gap created by the overhang portion. Alternatively, the nesting portion can have an axial dimension that is less than an axial dimension of the gap created by the overhang portion. Alternatively, the nesting portion can have an axial dimension that is approximately equal to than an axial dimension of the gap created by the overhang portion.

Stated otherwise, the gap created by the overhang portion of a first fin can at least partially receive the collar portion of a second fin. The first fin (and/or second fin) can be configured such that, when the gap created by the overhang portion of the first fin at least partially receives the collar portion of the second fin, the most radially inward portion of the first fin is at a radius that is approximately equal to the radius of the most radially inward of the second fin. Thus, the overhang portion of the first fin can provide resistance to deformation of the second fin's collar portion when the tube is expanded. While the overhang portion of the first fin can provide resistance of deformation in the radial direction, various aspects of the disclosed technology can, alternatively or in addition, provide resistance of deformation in the axial direction. For example, the various designs described herein can provide enhanced stability to the collar portion of a given fin, such that the collar portion of a first fin can prevent axial deformation of an abutting second fin during tube expansion (e.g., by a bullet, which can cause axial deformation of fins).

The overhang portion can be defined by various components, depending on the particular design and/or example. Referring to the fin 200 shown in FIG. 2B, the overhang portion can be defined by one, some, or all of the first bend 221, the first portion 222, and/or the second bend 223. Referring to the fin 300 shown in FIG. 3B, the overhang portion can be defined by the first bend 321. Referring to the fin 400 shown in FIG. 4B, the overhang portion can be defined by the first bend 421. Referring to the fin 500 shown in FIG. 5B, the overhang portion can be defined by one, some, or all of the second bend 523, the second portion 524, and/or the third bend 525. Similarly, referring to the fin 600 shown in FIG. 6B, the overhang portion can be defined by one, some, or all of the second bend 623, the second portion 624, and/or the third bend 625.

Alternatively or in addition, referring to the fin 700 shown in FIG. 7B, the overhang portion can be defined by one or more apertures (e.g., aperture 740) located in the fin portion 710 or the collar portion 720 and configured to receive at least a portion of the collar portion (e.g., protrusion 730).

Figure 8:
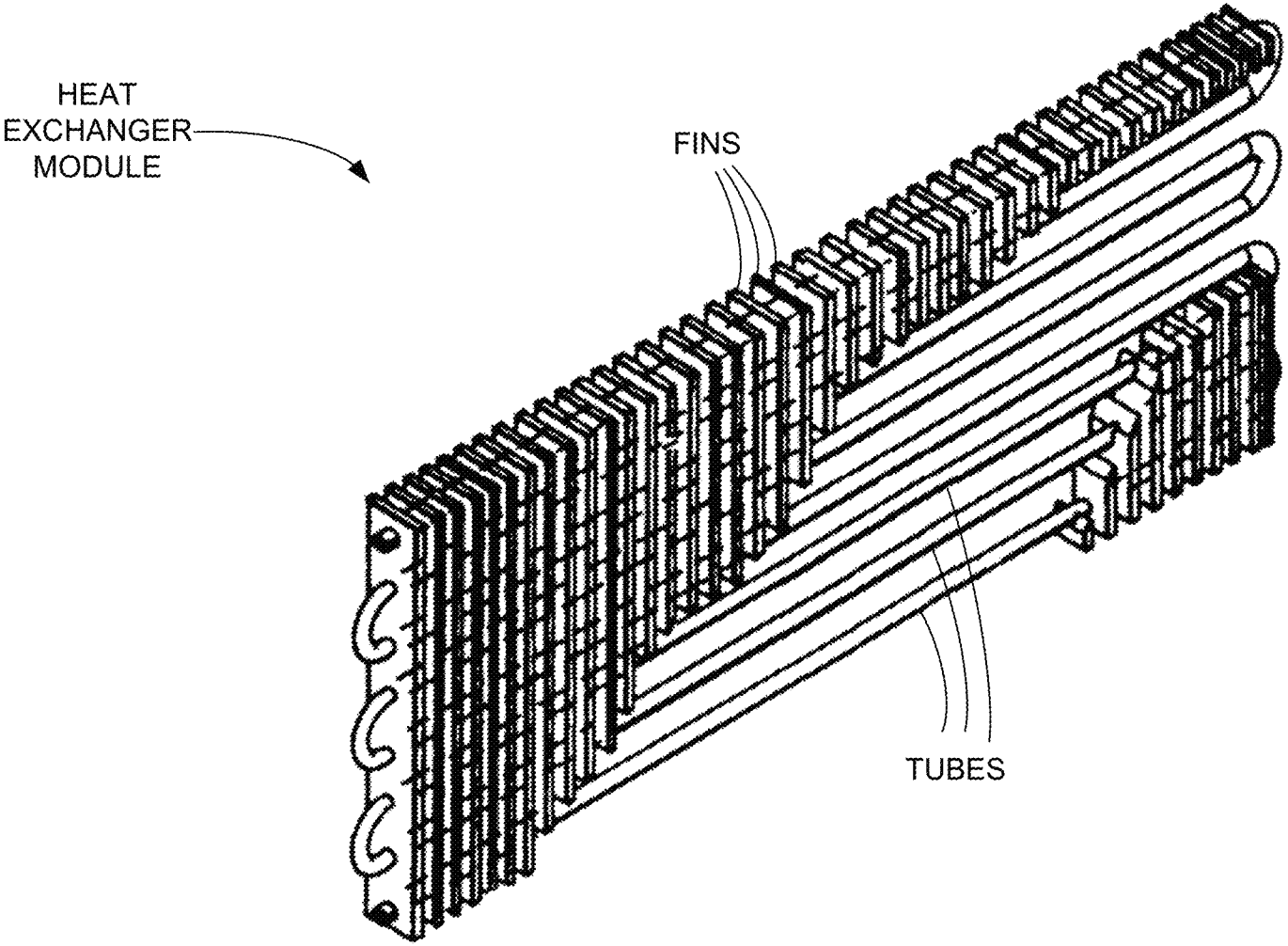
FIG. 8 illustrates a partially cut-away perspective view of a heat exchanger module comprising a plurality of heat exchanger tubes and plurality of fins, in accordance with the disclosed technology.

Referring to FIG. 8, the disclosed technology includes a heat exchanger. The heat exchanger can include one or more heat exchanger modules (e.g., heat exchanger slabs), and each heat exchanger module can include one or more heat exchanger tubes (e.g., tube 10) and one or more heat exchanger fins (e.g., fin 200, 300, 400, 500, 600, and/or 700). The heat exchanger module can include any number of tubes and any number of fins. In addition to expanding the tubes to create contact between the tubes and the fins, manufacturing of the heat exchanger module can further include attaching one or more bends or joints to fluidly connect the interior portions of multiple tubes. The tubes and fins can comprise any material having sufficiently high heat transfer characteristics. For example, the tubes and/or fins can comprise aluminum or copper. The tubes and fins can comprise the same material, or the tubes can comprise a material In this description, numerous specific details have been set forth. It is to be understood, however, that implementations of the disclosed technology may be practiced without these specific details. In other instances, well-known methods, structures, and techniques have not been shown in detail in order not to obscure an understanding of this description. References to "one embodiment," "an embodiment," "one example," "an example," "some examples," "example embodiment," "various examples," "one implementation," "an implementation," "example implementation," "various implementations," "some implementations," etc., indicate that the implementation(s) of the disclosed technology so described may include a particular feature, structure, or characteristic, but not every implementation necessarily includes the particular feature, structure, or characteristic. Further, repeated use of the phrase "in one implementation" does not necessarily refer to the same implementation, although it may.

Further, certain methods and processes are described herein. It is contemplated that the disclosed methods and processes can include, but do not necessarily include, all steps discussed herein. That is, methods and processes in accordance with the disclosed technology can include some of the disclosed while omitting others. Moreover, methods and processes in accordance with the disclosed technology can include other steps not expressly described herein.

Throughout the specification and the claims, the following terms take at least the meanings explicitly associated herein, unless otherwise indicated. The term "or" is intended to mean an inclusive "or." Further, the terms "a," "an," and "the" are intended to mean one or more unless specified otherwise or clear from the context to be directed to a singular form. By "comprising," "containing," or "including" it is meant that at least the named element, or method step is present in article or method, but does not exclude the presence of other elements or method steps, even if the other such elements or method steps have the same function as what is named.

While certain examples of this disclosure have been described in connection with what is presently considered to be the most practical and various examples, it is to be understood that this disclosure is not to be limited to the disclosed examples, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain examples of the technology and also to enable any person skilled in the art to practice certain examples of this technology, including making and using any apparatuses or systems and performing any incorporated methods. The patentable scope of certain examples of the technology is defined in the claims and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A heat exchanger fin comprising:

a fin portion; and a collar portion defining a fin aperture having a central axis, the collar portion disposed at a substantially perpendicular angle with respect to the fin portion, wherein the collar portion comprises:

a nesting end including a nesting portion, a bend, and an extending portion disposed at a substantially perpendicular angle with respect to the fin portion, wherein the extending portion extends over the collar portion;

a receiving end that (i) is located apart from the nesting end in an axial direction and (ii) comprises one or more bends to form an overhang portion that defines a gap located radially inward of the overhang portion, the gap being dimensioned to at least partially receive the nesting portion; and a contact portion extending between the nesting end and the receiving end, the contact portion configured to abut an outer surface of a tube when the tube is at least partially inserted into the fin aperture.

2. The heat exchanger fin of claim 1, wherein when the tube is at least partially inserted into the fin aperture, the gap radially extends between the overhang portion and the outer surface of the tube.

3. The heat exchanger fin of claim 1, wherein the receiving end comprises a single bend.

4. The heat exchanger fin of claim 1, wherein:

the bend of the nesting end is less than approximately 180 degrees, and the extending portion extends radially outward from the bend of the nesting end.

5. The heat exchanger fin of claim 1, wherein:

the bend of the nesting end is between approximately 90 degrees and approximately 180 degrees, and the extending portion extends at least partially in an axial direction.

6. The heat exchanger fin of claim 1, wherein at least one of the nesting end or the receiving end is rounded.

7. A heat exchanger comprising:

a heat exchanger tube; and a plurality of stacked heat exchanger fins, each comprising:

a fin portion; and a collar portion defining a fin aperture having a central axis, wherein the collar portion is disposed at a substantially perpendicular angle with respect to the fin portion, and wherein the heat exchanger tube passes through the fin aperture, the collar portion comprising:

a nesting end including a nesting portion, a bend, and an extending portion disposed at a substantially perpendicular angle with respect to the fin portion, wherein the extending portion extends over the collar portion;

a receiving end that (i) is located apart from the nesting end in an axial direction and (ii) comprises one or more bends to form an overhang portion that defines a gap that radially extends between the overhang portion and an outer surface of the heat exchanger tube, the gap being dimensioned to at least partially receive the nesting portion of an adjacent heat exchanger fin; and a contact portion extending between the nesting end and the receiving end, the contact portion abutting the outer surface of the heat exchanger tube.

* * * * *